US005094486A

United States Patent [19]

Foster

[11] Patent Number: 5,094,486

[45] Date of Patent: Mar. 10, 1992

[54] DEAD BOLT ASSEMBLY

[76] Inventor: Merle L. Foster, R.R. 5, Boone, Iowa 50036

[21] Appl. No.: 757,230

[22] Filed: Sep. 10, 1991

[51] Int. Cl.[5] ..... E05B 55/04

[52] U.S. Cl. ..... 292/167; 292/166; 292/DIG. 62; 292/336.3; 70/109

[58] Field of Search ..... 292/139, 166, 167, 173, 292/336.3, DIG. 62; 70/109, DIG. 63

[56] References Cited

U.S. PATENT DOCUMENTS

| | | | |
|---|---|---|---|
| 541,454 | 6/1895 | Sweigart et al. | 292/166 X |
| 2,203,817 | 6/1940 | Ferris | 292/166 |
| 2,275,128 | 3/1942 | Campbell | 292/166 X |
| 3,064,462 | 11/1962 | Ng et al. | 292/173 X |
| 4,116,027 | 9/1978 | Tannery | 292/173 X |
| 4,422,677 | 12/1983 | Gates | 292/167 X |

OTHER PUBLICATIONS 4500 and 4600 Series Small Cylinder Dead Bolts—Installation Instructions 0001-10-8130.

*Primary Examiner*—Richard E. Moore
*Attorney, Agent, or Firm*—Zarley, McKee, Thomte, Voorhees & Sease

[57] ABSTRACT

A lock mechanism for a dead bolt assembly. The lock assembly includes a conventional key actuated cylinder for mounting outside the door for extending and retracting the dead botl between a locked and an unlocked position. An exterior thumb turn assembly is accessible from the exterior of the door and includes a rotatable actuator arm which is connected to a pushing link for pushing the dead bolt from its retracted to its extended position. The exterior thumb turn, however, does not permit the retraction of the dead bolt, but only permits its extension.

13 Claims, 3 Drawing Sheets

DEAD BOLT ASSEMBLY

BACKGROUND OF THE INVENTION

This invention relates to a lock mechanism, and particularly to a lock mechanism of the dead bolt variety.

Prior dead bolt lock mechanisms include a dead bolt which can be moved from a retracted to an extended position. The exterior of the door includes a keyed lock cylinder which is operable by means of a key to move the dead bolt from its retracted to its extended position. Often on the inside of the door there is a thumb turn which can be rotated to move the dead bolt between its opened and closed positions.

One disadvantage of prior dead bolt lock systems is that the dead bolt can only be moved to its extended or locked position from outside the door by means of a key. Thus, with present locks, a person must locate and use a key in order to lock the dead bolt from the outside.

SUMMARY OF THE INVENTION

Therefore, a primary object of the present invention is the provision of an improved lock mechanism.

A further object of the present invention is the provision of an improved lock mechanism having a thumb turn capable of moving the dead bolt to its extended position, but being incapable of returning the dead bolt to its retracted or unlocked position.

A further object of the present invention is the provision of an improved lock mechanism which can be easily locked from the outside without using a key, but which requires a key for unlocking from the outside.

A further object of the present invention is the provision of an improved lock mechanism which is economical to manufacture, durable in use, and efficient in operation.

DETAILED DESCRIPTION OF THE PREFERRED EMBODIMENT

Figure 1:
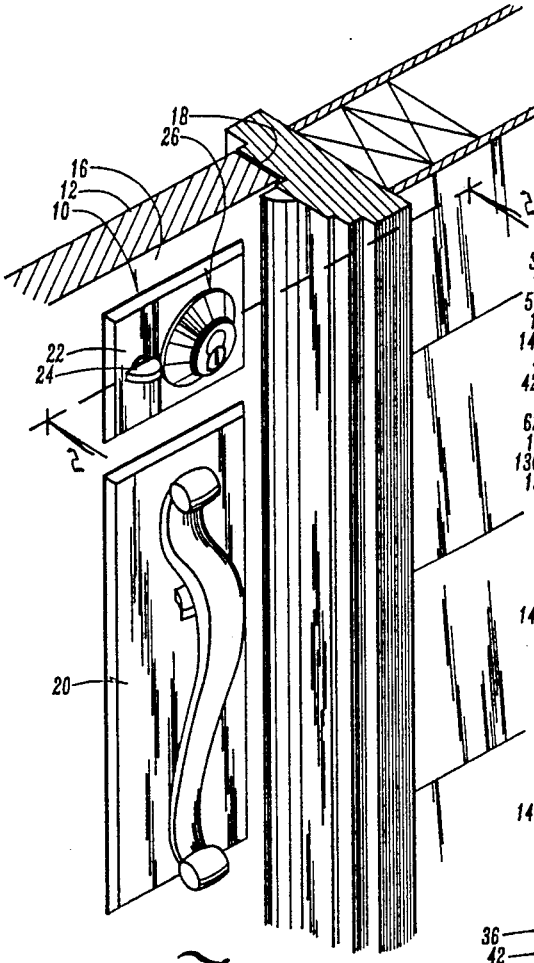
FIG. 1 is a perspective view of the exterior of a door having the lock assembly of the present invention thereon.

Referring to the drawings, the numeral 10 generally designates a dead bolt assembly of the present invention. Lock assembly 10 is shown mounted to a door 12 having an inner face 14, an outer face 16, and a latch edge 18. Mounted on the exterior face 16 of door 12 is a conventional handle and latch assembly 20.

Figure 6:
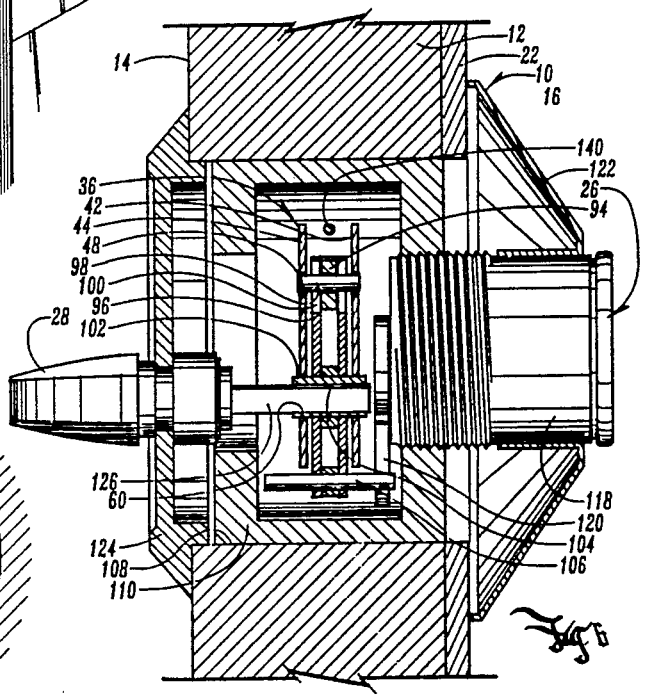
FIG. 6 is a sectional view taken along line 6—6 of FIG. 2.
Figure 7:
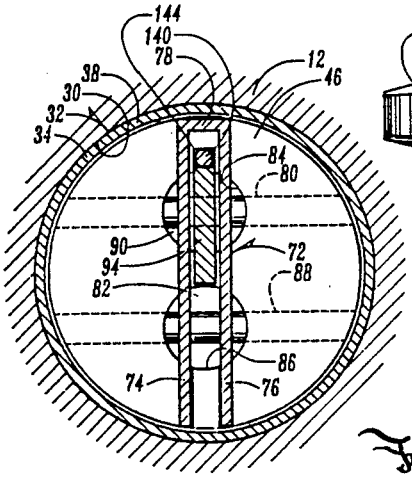
FIG. 7 is a sectional view taken along line 7—7 of FIG. 2.

Dead bolt assembly 10 includes a cover plate 22, an outer thumb turn 24, a cylinder assembly 26, and an inner thumb turn 28 (FIG. 6). Extending inwardly from the latch edge 18 of door 12 is a bolt receiving hole 30 which receives a bolt assembly 32.

Bolt assembly 32 includes a bolt housing 34 which is comprised of a lock frame 36 and a cylindrical sleeve 38. Sleeve 38 has integrally formed therewith a flat edge plate 40. Lock frame 36 includes a pair of spaced apart frame plates 42, 44 having arcuate side flanges 46 (FIG. 10) which are adapted to be welded or otherwise secured within cylindrical sleeve 38 of bolt housing 34 so as to secure bolt housing 34 and lock frame 36 together into an integral piece.

Frame plates 42, 44 each include a first guide slot 48 and a second guide slot 50. Guide slot 48 is elongated and includes an abutment shoulder 52 at one end and a curved surface 54 at the other end. Guide slot 50 includes curved surfaces 56, 58 at its opposite ends. Frame plates 42, 44 also include a pair of spaced apart hub receiving holes 60, 62. The frame plates 42, 44 are held together in spaced relationship by means of a plurality of spacing rivots 64. Below hub receiving hole 60 are a pair of arcuate notches 66 which are formed in the lower edge of frame plates 42, 44.

Figure 2:
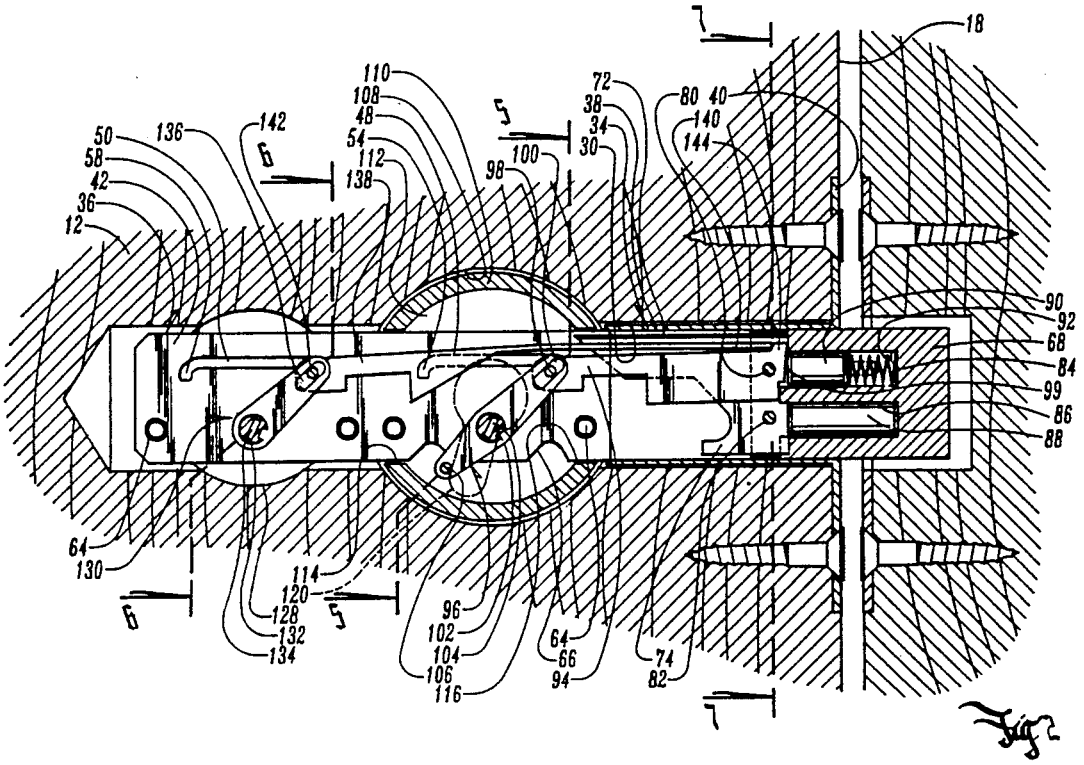
FIG. 2 is a sectional view taken along line 2—2 of FIG. 1, and showing the exterior thumb latch urging the dead bolt to its extended locked position.
Figure 3:
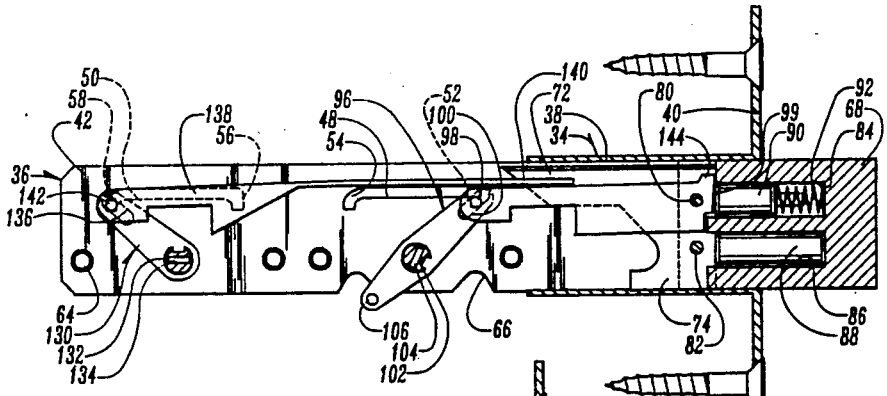
FIG. 3 is a view similar to FIG. 2, but showing the exterior thumb turn moved to its initial position while the dead bolt remains in its extended position.
Figure 4:
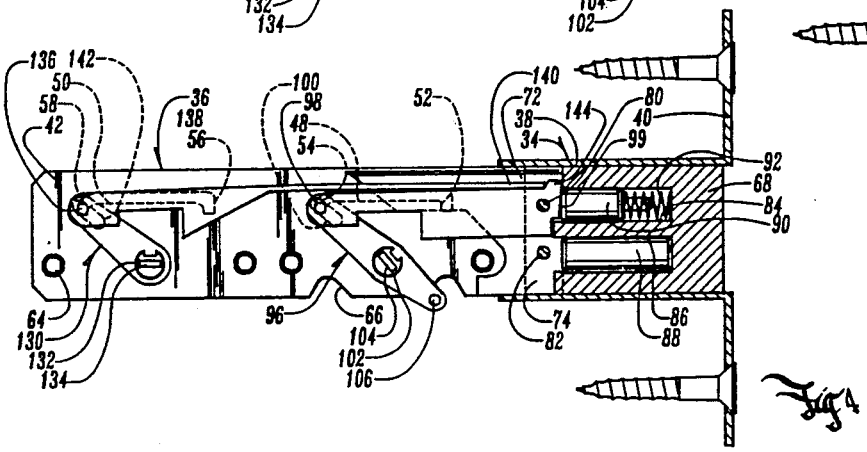
FIG. 4 is a sectional view similar to FIGS. 2 and 3, but showing the dead bolt in its retracted position.
Figure 8:
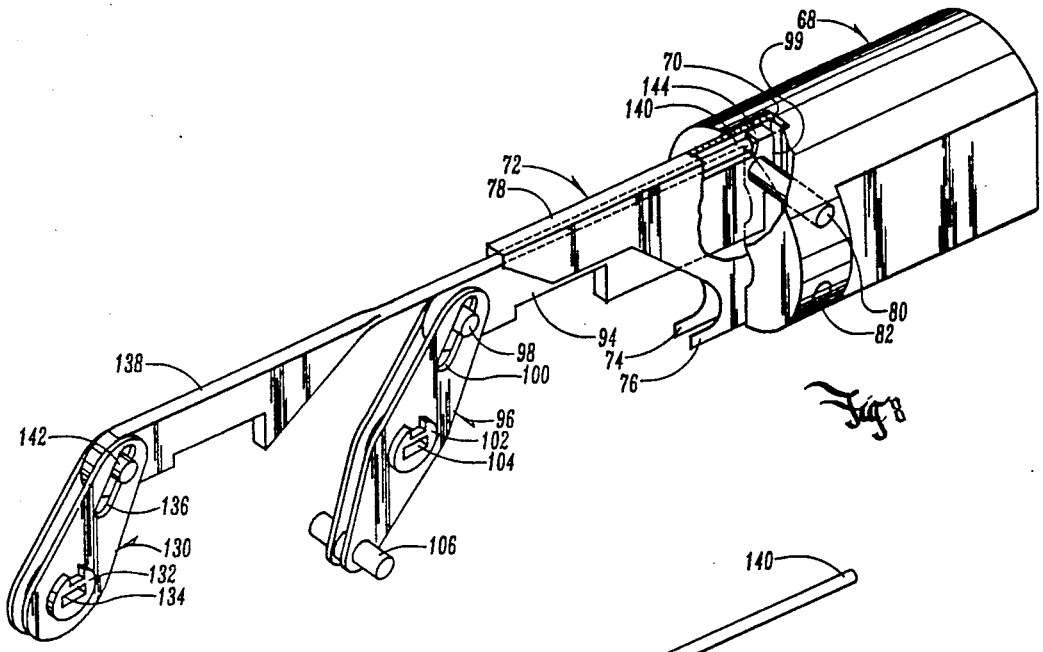
FIG. 8 is a detailed perspective view of the dead bolt and the two actuator mechanisms for moving the dead bolt.

Slidably mounted within sleeve 38 is a dead bolt 68. Dead bolt 68 includes at its inner end a vertical slot 70 in which is fitted a shroud 72. Shroud 72 is comprised of two spaced apart shroud sides 74, 76 (FIG. 8) and a web 78 interconnecting the two. Shroud 72 is attached to dead bolt 68 by means of a pair of locking pins 80, 82 which extend through the rear end of bolt 68 and also through complimentary holes in the shroud 72. As can be seen in FIGS. 2–4, bolt 68 includes at its inner end a pair of axially extending bores 84, 86 each of which is provided with a pin 88, 90 respectively. The upper pin 90 is spring mounted so as to be urged axially out of axial bore 84 by means of a spring 92.

A first link 94 is pivotally mounted adjacent its forward end to dead bolt 68 by means of locking pin 80. The other end of link 94 is pivotally connected to an actuator arm 96 by means of a linkage pin 98. First link 94 at its forward end includes inclined edge 99 which engages upper pin 90. Because of the inclined angle of edge 99, the pin 90 causes link 94 to be biased in a counterclockwise direction about locking pin 80 as viewed in FIG. 3. This causes the linkage pin 98 to be urged downwardly so that it is retained by shoulder 52 of guide slot 48 in the position shown in FIG. 3.

Linkage pin 98 extends through a pin slot 100 in actuator arm 96. Arm 96 includes a keyed hub having a tail piece slot 104 extending therethrough. Hub 102 is rotatably fitted within hub receiving holes 60 so that actuator arm 96 will rotate about the axis provided by hub 102. At the lower end of actuator arm 96 are a pair of outwardly extending lower actuating pins 106.

Rotation of actuator arm 96 from the position shown in FIG. 3 to the position shown in FIG. 4 causes the dead bolt 68 to be withdrawn from its extended position shown in FIG. 3 to its retracted position shown in FIG. 4. The rotational movement of member 96 is such that it permits the linkage pin 98 to be lifted upwardly out of engagement with shoulder 52 so that movement to the retracted position can be obtained.

Actuator arm 96 and the hub 102 thereof are centered within a cylinder hole 108 which extends through door 12 from the front surface through the back surface thereof. A cylinder housing 110 is fitted over the spaced apart plates 42, 44 and is also fitted within cylinder hole 108 as shown in FIG. 2. Cylinder housing 110 has an open center 112, and side slots 114, 116 for permitting the mounting of cylinder housing 110 over the spaced apart plates 42, 44.

A lock cylinder 118 which is of conventional construction and which is adapted to be actuated by a key of predetermined configuration, includes a cylinder arm 120 which at its lower end is connected to lower actuator pin 106 of the actuator arm 96. Lock cylinder 118 is threadably received within cylinder housing 110, and a cylinder ring plate 122 is mounted around cylinder 118 in facing relation to the outer surface of cover plate 22 on the outer face 16 of door 12. Actuation of lock cylinder 118 by means of an appropriate key causes cylinder arm 120 to rotate, thus transmitting rotational movement to the actuator arm 96. Thus by means of an appropriate key, it is possible to extend the dead bolt 68 to its locked position or to retract the dead bolt 68 to its retracted position.

On the inside surface of the door, the inner thumb turn 28 is also adapted to permit the manual extension and retraction of dead bolt 68. Surrounding inner thumb turn 28 is an inner rose 124 which is in facing engagement with the inner surface 14 of door 12. Extending from thumb turn 28 is an inner tail piece 126 (FIG. 6) which extends through tail piece slot 104. Thus rotation of thumb turn 28 causes corresponding rotation of actuator arm 96, which is transferred through link 94 to dead bolt 68 for extending and retracting dead bolt 68.

Figure 9:
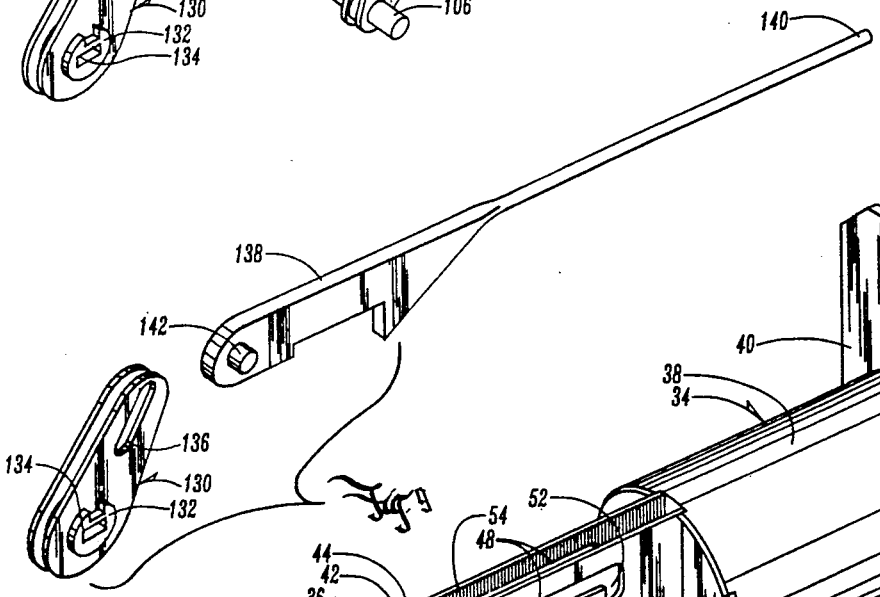
FIG. 9 is an exploded perspective view of the exterior thumb turn actuator and the link attached thereto.
Figure 10:
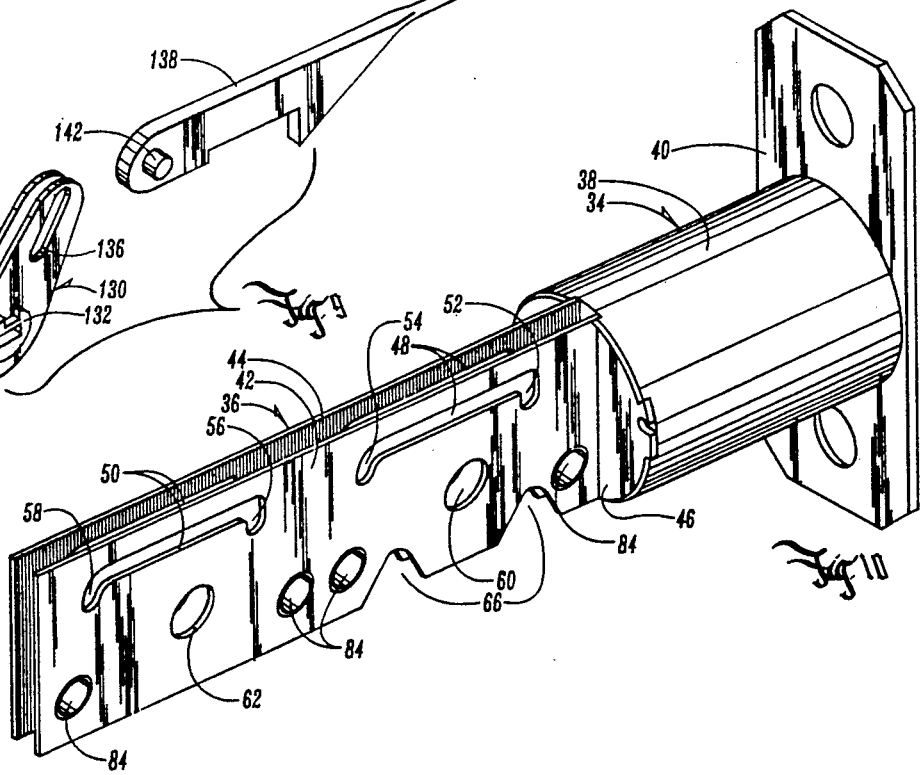
FIG. 10 is a perspective view of the bolt housing and lock frame of the present invention.

Extending through door 12 in side-by-side relation with cylinder hole 108 is a secondary hole 128 which provides communication to the inner end of bolt receiving hole 30 and also provides communication to the inner end of bolt assembly 32. Pivotally mounted to bolt assembly 32 is a second actuator arm 130 (FIGS. 2–4) having a hub 132 which rotates within hub receiving hole 62 (FIG. 10). Hub 132 includes a tail piece slot 134 extending therethrough. At the upper end of second actuator arm 130 is a pin slot 136 which is adapted to receive a pivot pin 142 of pushing link 138. Pushing link 138 is shown in FIG. 9 and includes at one of its ends a pushing end 140 which is adapted to engage a shoulder 144 (FIG. 3) on first link 94.

Figure 5:
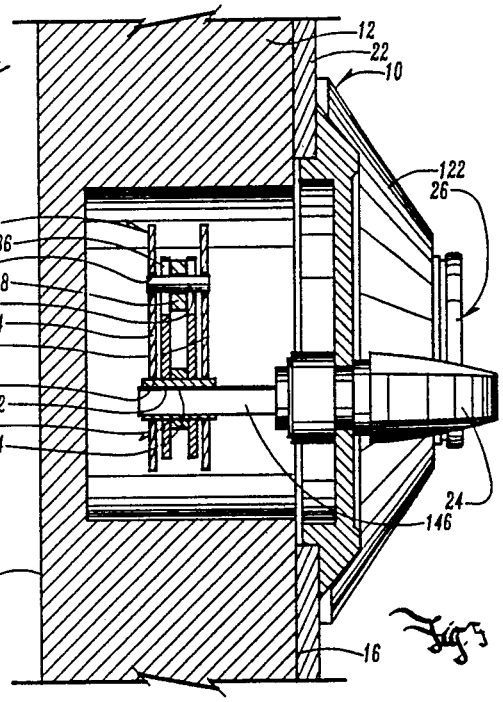
FIG. 5 is a sectional view taken along line 5—5 of FIG. 2.

Outer thumb turn 24 includes a tail piece 146 (FIG. 5) which protrudes within tail piece slot 134 of second actuator arm 130. The operation of second actuator arm 130 is shown in FIGS. 2–4. Referring to FIG. 4, the dead bolt 68 is shown in its retracted position. A person exiting through the door can close the door from the outside, rotate outer thumb turn 24 in a clockwise direction as viewed in FIG. 2, and cause the second actuator arm 130 and the pushing link 138 to move the dead bolt 68 from the position shown in FIG. 4 to the position shown in FIG. 2. This is accomplished by virtue of the cooperation between pushing end 140 and the shoulder 144 on link 94. It is also possible for the pushing end 140 to directly engage the dead bolt 68 rather than the shoulder 144.

One feature which facilitates the movement of the dead bolt from the position in FIG. 4 to the position in FIG. 2 in response to rotation of thumb turn 24 is the arcuate portion 54 of first guide slot 48 which permits linkage pin 98 to ride upwardly and slide longitudinally within slot 48 to the position shown in FIG. 2. Similarly, the arcuate portions 56, 58 of second guide slot 50 also permit link pin 142 to slide longitudinally within the guide slot 50 from the position shown in FIG. 4 to the position shown in FIG. 2.

However, while it is possible to extend dead bolt 68 with thumb turn 24, it is not possible to retract dead bolt 68 as is readily shown by FIG. 3. FIG. 3 shows the thumb turn 24 rotated in a counterclockwise direction (as viewed in FIG. 3) so as to cause link 130 to retract pushing link 138 to the left. Because link 138 is not connected to dead bolt 68 or to the link 94, it merely moves to the left without causing a corresponding movement of the dead bolt 68. Thus, it is possible to lock dead bolt 68 by means of thumb turn 24, but it is not possible to unlock dead bolt 68 with the thumb turn 24.

Unlocking of the dead bolt must be accomplished either by the use of an appropriate key in cylinder assembly 26 or by the rotation of the interior thumb turn 28 from inside the door.

Thus, it can be seen the device accomplishes at least all of its stated objectives.

I claim:

1. A lock mechanism for use with an elongated dead bolt slidably mounted within cylindrical bolt sleeve, said sleeve and said dead bolt each having an outer axial end and an inner axial end, said dead bolt being longitudinally movable within said sleeve for movement from a retracted position wherein said dead bolt is substantially completely within said sleeve to an extended position wherein said outer axial end of said dead bolt protrudes outwardly beyond said outer axial end of said sleeve, said lock mechanism comprising:

a lock frame connected to said bolt sleeve;

a first actuator means rotatably mounted to said lock frame for rotation about a first axis perpendicular to the cylindrical axis of said sleeve for movement from a locked position to an unlocked position;

first linkage mechanism pivotally interconnecting said first actuator means and said dead bolt for causing said dead bolt to move to said extended position in response to said first actuator means moving to said locked position and for causing said dead bolt to move to said retracted position in response to said first actuator means moving to said unlocked position;

a second actuator means rotatably mounted to said lock frame for rotation about a second axis perpendicular to said cylindrical axis of said sleeve for movement from a first position to a second position;

second linkage mechanism pivotally connected to said second actuator means and having at least one link engageable with one of said dead bolt and said first linkage mechanism to move said dead bolt from said retracted position to said extended position in response to said second actuator means moving to said second position, said second linkage mechanism being disconnected from said dead bolt and said first linkage mechanism whereby said dead bolt will stay in said extended position in response to said second actuator means moving from said second to said first position.

2. A lock mechanism according to claim 1 wherein said second actuator means comprises a lever having first and second opposite ends, said lever being pivotally mounted to said lock frame for pivotal movement about said second axis spaced from said second end of said lever, said second linkage mechanism being pivotally connected to said lever for pivotal movement about a second link axis spaced from said second axis.

3. A lock mechanism according to claim 2 wherein said one link of said second linkage mechanism is elongated and includes a pushing end, said pushing end being drivingly engageable with said one of said dead bolt and said first linkage mechanism during movement of said second actuator means from said first to said second positions and being removable from driving engagement with said one of said dead bolt and said first linkage mechanism when said second actuator moves from said second to said first position.

4. A lock mechanism according to claim 3 wherein said lock frame includes an elongated second guide slot therein, a second pivot pin providing said second link axis, said second pivot pin also extending within said second guide slot and moving longitudinally therein during movement of said second actuator means from said first position to said second position, said second guide slot being shaped to permit free movement of said second linkage mechanism and said second actuator means back and forth between said first and second positions.

5. A lock mechanism according to claim 4 wherein a first pivot pin pivotally connects said first linkage mechanism to said first actuator means for pivotal movement about a first link axis, said lock frame having an elongated first guide slot therein, said first pivot pin extending within said first guide slot and moving longitudinally therein during movement of said first actuator means from said locked to said unlocked position.

6. A lock mechanism according to claim 5 wherein said first guide slot includes a stop portion for engaging said first pivot pin when said first actuator is in said locked position to limit movement of said dead bolt from said extended to said retracted positions, said stop portion of said first guide slot being shaped so as to permit said linkage mechanism to move said dead bolt from said extended to said retracted position only in response to movement of said first actuator means from said locked to said unlocked position.

7. A lock mechanism according to claim 6 and further comprising spring means engaging said first linkage mechanism and yieldably urging said first pivot pin toward said stop portion off said first guide slot when said bolt is in said extended position.

8. A lock mechanism according to claim 7 wherein said spring means comprises a spring engaging said first linkage mechanism member and a spring yieldably engaging said spring member, said dead bolt having a spring bore therein, said spring and said spring member being fitted within said spring bore.

9. A lock mechanism according to claim 7 wherein a third pivot pin pivotally connects said first linkage mechanism to said dead bolt for pivotal movement about a third axis, said spring means engaging said first linkage mechanism at a contact point spaced from said third axis whereby said spring means will yieldably urge said first linkage mechanism in a predetermined rotational direction about said third axis.

10. In combination:

a door having a latch edge, an upper edge, a lower edge, a front face and a rear face;

said door having a bolt receiving hole extending inwardly from said latch edge, a cylinder receiving hole extending through said front and rear faces of said door perpendicularly to and in communication with said bolt receiving hole, and a secondary hole extending through said front and rear faces of said door perpendicularly to and in communication with said bolt receiving hole;

a bolt assembly fitted within said bolt receiving hole, said bolt assembly comprising a cylindrical bolt sleeve, a lock frame connected to said bolt sleeve, and a dead bolt slidably mounted within said sleeve for movement from a retracted position whereby said bolt is substantially completely within said bolt receiving hole to an extended position whereby said bolt protrudes from said latch edge of said door;

a first actuator means rotatably mounted to said lock frame within said cylinder receiving hole for rotation about a first axis perpendicular to the cylindrical axis of said bolt sleeve for movement from a locked position to an unlocked position;

first linkage mechanism pivotally interconnecting said first actuator means and said dead bolt for causing said dead bolt to move to said extended position in response to said first actuator means moving to said locked position and for causing said dead bolt to move to said retracted position in response to said first actuator means moving to said unlocked position;

a second actuator means within said secondary hole of said door and being rotatably mounted to said lock frame for rotation about a second axis perpendicular to said cylindrical axis of said sleeve for movement from a first position to a second position;

second linkage mechanism pivotally connected to said second actuator means and having at least one link engageable with one of said dead bolt and said first linkage mechanism to move said dead bolt from said retracted position to said extended position in response to said second actuator means moving to said second position, said second linkage mechanism being disconnected from said dead bolt and said first linkage mechanism whereby said dead bolt will stay in said extended position in response to said second actuator means moving from said second position to said first position.

11. A combination according to claim 10 wherein a key actuatable cylinder assembly is fitted within said cylinder receiving hole of said door, said cylinder having a driving member in driving engagement with said first actuator means, said cylinder having a key receiving slot accessible at said front face of said door.

12. A combination according to claim 11 wherein an outer thumb turn assembly is mounted within said secondary hole and includes an outer tail piece member in driving engagement with said second actuator means, said outer thumb turn assembly including an outer thumb turn portion which is accessible at said front face of said door.

13. A combination according to claim 12 wherein an inner thumb turn assembly is mounted within said cylinder hole and includes an inner tail piece member in driving engagement with said first actuator means, said inner thumb turn assembly further including an inner thumb turn portion which is accessible at said rear face of said door.

* * * * *